US008555421B2

(12) United States Patent
Herman

(10) Patent No.: US 8,555,421 B2
(45) **Date of Patent: *Oct. 15, 2013**

(54) UNDERGARMENT SUSPENDERS ATTACHED TO HIPS AT TWO LOCATIONS

(71) Applicant: Sal Herman, Bloomfield Hills, MI (US)

(72) Inventor: Sal Herman, Bloomfield Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/631,160

(22) Filed: Sep. 28, 2012

(65) Prior Publication Data

US 2013/0019382 A1 Jan. 24, 2013

Related U.S. Application Data

(63) Continuation of application No. 13/198,469, filed on Aug. 4, 2011, which is a continuation-in-part of application No. 12/872,014, filed on Aug. 31, 2010, now Pat. No. 8,209,779.

(51) Int. Cl.
*A41F 19/00* (2006.01)

(52) U.S. Cl.
USPC ..... 2/327; 2/326

(58) Field of Classification Search
USPC ..... 2/326, 327, 304, 305, 307, 308, 2/310–312, 336, 321, 322
See application file for complete search history.

(56) References Cited

U.S. PATENT DOCUMENTS

| | | | | | |
|---|---|---|---|---|---|
| 1,392,935 | A | * | 10/1921 | Glickman | 2/326 |
| 2,440,982 | A | * | 5/1948 | Speller et al. | 2/305 |
| 3,480,275 | A | * | 11/1969 | Glass et al. | 273/453 |
| 3,501,774 | A | * | 3/1970 | Norman | 2/321 |
| 4,213,548 | A | * | 7/1980 | Wood | 224/168 |
| 4,481,682 | A | * | 11/1984 | Hall | 2/326 |
| 5,497,923 | A | * | 3/1996 | Pearson et al. | 224/639 |
| 5,560,046 | A | * | 10/1996 | Iwamasa et al. | 2/328 |
| 6,125,475 | A | * | 10/2000 | Taylor | 2/333 |

* cited by examiner

*Primary Examiner* — Gloria Hale
(74) *Attorney, Agent, or Firm* — John A. Artz; Dickinson Wright PLLC

(57) ABSTRACT

Suspenders having a pair of strap members particularly for wearing under outer garments. At least one side of each of the strap member has loop members thereon which mate with pieces of hook-type material secured adjacent one end of each of the strap members. The pair of strap members are connected together to allow fasteners to the wearer's pants with just two fastener members. Adjustment buckles are eliminated.

5 Claims, 6 Drawing Sheets

UNDERGARMENT SUSPENDERS ATTACHED TO HIPS AT TWO LOCATIONS

CROSS-REFERENCE TO RELATED APPLICATIONS

This application is a continuation of U.S. patent application Ser. No. 13/198,469 filed on Aug. 4, 2011, which is a continuation-in-part of U.S. patent application Ser. No. 12/484,581 filed on Jun. 15, 2009, now U.S. Pat. No. 8,209, 779.

TECHNICAL FIELD

The present invention relates to suspenders and more particularly to suspenders designed to be worn under clothing.

BACKGROUND

Suspenders used to support pants or trousers on a person's body are in common use today. There are many types of known suspenders and they typically include a pair of straps which fit over the shoulders of the wearer and ends which attach to the waistband of the pants. The suspenders have a pair of straps extending vertically along the front torso of the wearer for attachment to the front of the pants, and at least one strap on the back of the wearer which also is adapted to be connected to the pants.

The ends of the straps of the suspenders are attached to the pants in a number of ways. The straps typically are attached to the pants with buttons or clips. As to button attachments, the buttons are sewn on the pants near the waistline, and the ends of the straps have button holes or attachments with button holes. As to clips, various types of clips are in use today such as those found in U.S. Design Pat. Nos. D614,946 and D619, 495.

Suspenders to hold up socks are also known, although not as common as suspenders used to support pants or trousers. These suspenders typically have bands of elastic which are positioned around the wearer's calves, together with a short strap having a fastener for attachment to the wearer's socks. The fasteners can be the same or similar to those used on the suspenders for pants.

Most of the known suspenders, either for socks or pants, also have buckles near the ends of the straps in order to adjust the length of the straps. The ends of the straps are slipped through openings in the clips and extended back along the straps to the adjustment buckles.

Suspenders for pants are primarily designed to be worn over or outside a shirt, with the shirt being tucked into the pants. If the suspenders are covered with clothing, it is typically a suit coat, sport coat or another type of coat or jacket. Suspenders for socks are also typically worn under the pants or trousers of the wearer.

Today, however, numerous persons prefer to wear their shirts on the outside of their pants. This often creates a difficult or awkward situation if the wearers have suspenders under the shirts in the event that the wearers need to use the restroom facilities. Also, particularly if the shirt is form fitted, the buckles on the straps which are used to adjust the length of the straps cause unsightly bulges or bumps on the wearer's torso.

Suspenders for socks also can create unsightly bulges or bumps if worn under form fitting or tight pants. If the wearer desires to wear his/her shirt inside the pants, with or without outer pants suspenders, it is often difficult to hold the shirt tightly inside the pants.

SUMMARY OF THE INVENTION

Improved suspenders are provided which allow use under outer garments. The suspenders allow infinite adjustability of the straps and do not include buckles or other objects on the straps which could cause visible bulges or bumps.

In one embodiment for use with pants, a pair of straps are provided with fasteners at each end, particularly clip-type fasteners. The pair of straps are connected together preferably at a location on the back of the wearer when they are worn. The fasteners are connected to ring members which allow the ends of the straps to slide easily through them.

At one end of the two straps (at the back of the wearer), the ends are passed through the ring members and securely attached or connected to the straps. This can be done by sewing. At the other ends of the two straps (at the front of the wearer), the ends are passed loosely through the ring members. These ends have pieces of fastener material attached with a series of small hooks on it. The fastener materials are preferably pieces of hook-type Velcro material and are glued or otherwise securely affixed to the ends of the two front straps.

The material for the straps is provided on one side with a plurality of small loops along the surface. In this manner, the ends of the straps with the pieces of hook-type material on it can be positioned and secured anywhere on the strap. This provides significant benefits as to the ease of adjusting and releasing the suspender straps, as well as the elimination of buckles, bulges and bumps which show on outer garments when the suspenders are worn under them.

The opposite side of the strap material (i.e. the outside) preferably has a smoother or harder surface. This allows outer garments to slide freely over the straps without sticking or being hung-up.

The material for the straps also can be stretchable, which would further assist in the adjustability of the suspenders, as well as increase the comfort to the wearer.

In another embodiment for use with pants, the straps can have a different configuration. The pair of straps fit over the shoulder of the wearer, but are connected together at the sides of the wearer adjacent the wearer's waist. In this embodiment, only two fasteners are necessary to attach the suspenders to the wearer's pants. The front portions of the two straps have adjustment systems similar to that described above with respect to the first embodiment.

In an embodiment of a shirt-and-sock suspender, a "Y-shaped" suspender is provided. The suspender includes an elongated strap member connected to two shorter arm members. Fasteners are provided on the outer ends of the three strap members.

The strap members are preferably made from the same material described above that is used for the pants suspenders. The material has a plurality of small loops on one side and a smoother or harder surface on the other side. The elongated strap member is positioned through a ring member on a fastener and can be secured anywhere on the strap providing maximum adjustability. The shorter arm members can be fixedly attached to their fasteners, or they can be attached to their fasteners in the same manner as the elongated strap member to provide similar adjustability.

Preferably the three strap members are overlapped and connected fixedly together at the "V" of the Y-shaped configuration.

This sock-type suspender embodiment is positioned to extend between the bottom of the wearer's shirt garment and the wearer's socks. The fasteners on the ends of the two shorter arm members are used to attach to the bottoms (or "tails") of a shirt-type garment, while the fastener on the end of the elongated strap member is used to attach to the top of the wearer's socks. The wearer also should use two of the shirt-and-sock-type suspenders, one on each side of his body. In this manner, the wearer can maintain his/her shirt always in a neat and tucked-in position, while at the same time maintain his/her socks from sagging or falling down.

Other objects, features, benefits and advantages of the present application will become apparent from the following description of preferred embodiments of the invention when viewed in accordance with the accompanying drawings and appended claims.

DESCRIPTION OF THE PREFERRED EMBODIMENTS

Figure 1:
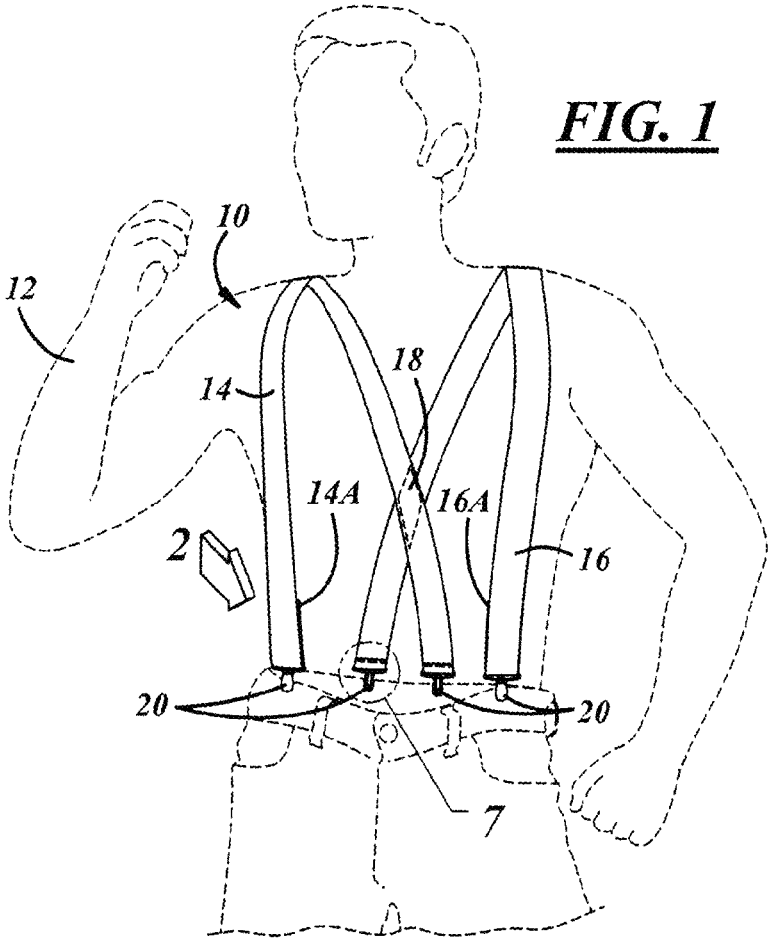
FIG. 1 is a first perspective view of pant-type suspenders as worn by a person.

An embodiment of the inventive pant-type suspender 10 is shown in FIG. 1 and is shown in a manner that it would be worn by a person or wearer 12. The suspender 10 includes a pair of strap members 14 and 16 which are attached together where they overlap 18 in a position at the back of a wearer when the suspender is worn.

Figure 2:
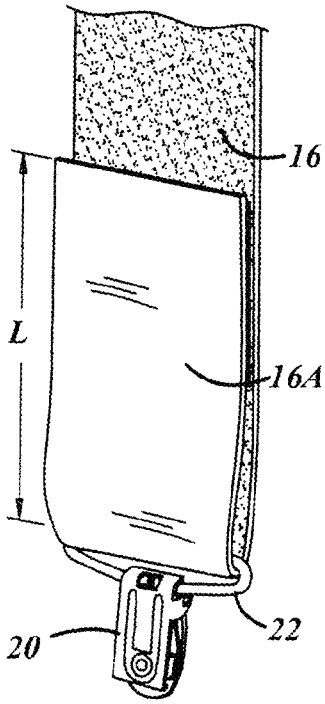
FIG. 2 is an enlarged view of a portion of FIG. 1.
Figure 4:
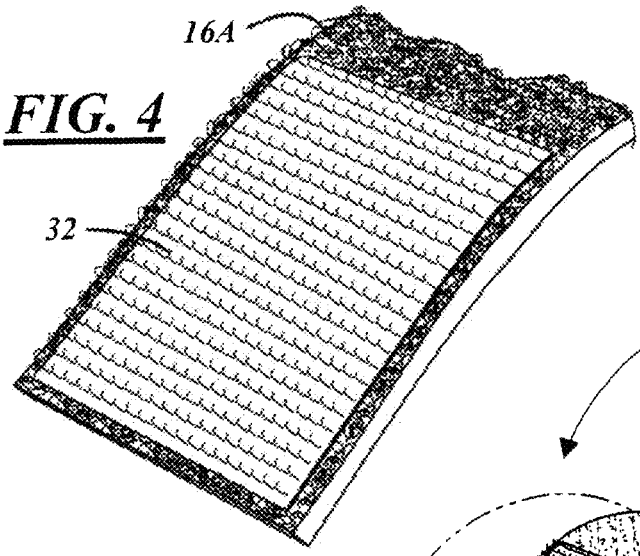
FIG. 4 is an enlarged view depicting the piece of material with hook members.

Each of the strap members have a sufficient length to extend from the waistline at the rear of the wearer to the waistline at the front of the wearer, plus an additional amount which is used to adjust the suspenders for different sizes and shapes of wearers. These additional amounts are indicated by the reference numerals 14A and 16A in the drawings, as well as by "L" in FIG. 2.

The strap members 14 and 16 are attached together at 18 where they overlap. They can be connected together by any mechanism or method which securely affixes them together, such as by being sewn together.

In this regard, it should be understood that the invention is not to be limited to suspenders having the precise structure and configuration as shown in FIG. 1. The invention can be utilized with most all of the various sizes, shapes and strap configurations of suspenders known today, such as those shown, for example, in U.S. Design Pat. No. D243,293. Another embodiment of suspenders which can utilize the present invention is shown in FIG. 8-11 and described below.

Fastener members 20 are used to connect the strap members to the pants or trousers worn by the wearer. Preferably, the fasteners 20 are clip-type fastener members, such as those shown in U.S. Design Pat. Nos. D614,946 and D619,495. However, the invention can be used with any type of conventional fastener members used with suspenders today, including buttons and snaps.

The fastener members 20 as shown have a loop or ring member 22 attached to them. The ring member 22 allows the strap members to slide through them.

Figure 7:
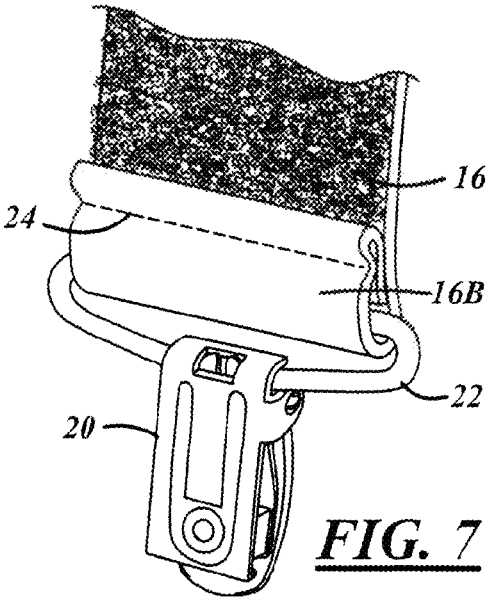
FIG. 7 depicts a fastener affixed to the end of a back strap member.

As to the portion of the suspenders which are to be positioned at the back of the wearer, the fastener members 20 are securely affixed to the ends of the strap members. This is shown, for example, in FIG. 7 where the end 16B of the strap member 16 is positioned through the ring member 22 and securely attached, such as by stitches 24 made by sewing, on the strap member. Preferably, both of the "rear" or "back" ends of the strap members 14 and 16 are connected to their respective fastener members in the same way.

Figure 3:
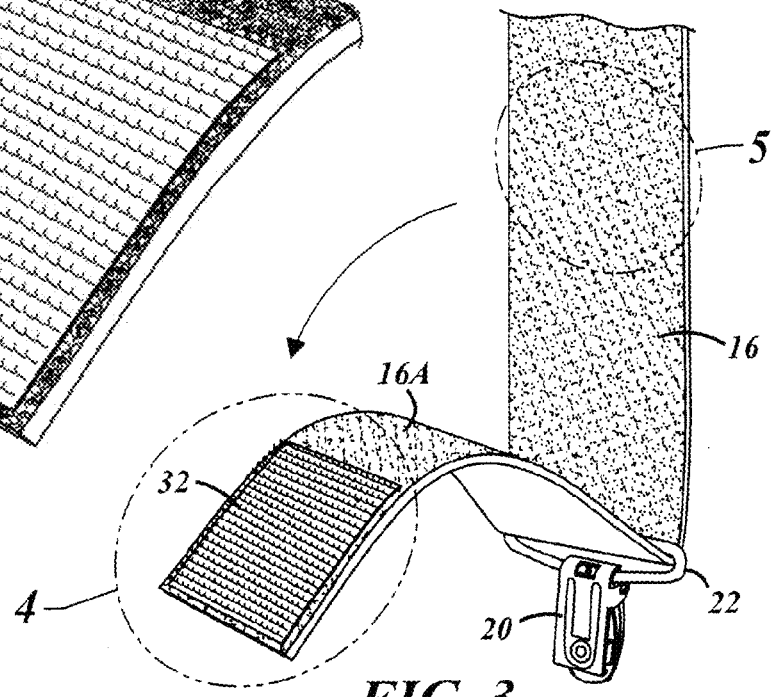
FIG. 3 depicts an unfastened end of a front strap.
Figure 5:
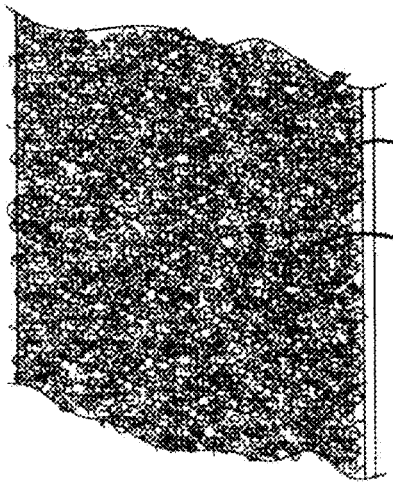
FIG. 5 is an enlarged view depicting the surface of the strap member with loop members.

The portion 16A of the strap member 16 is adapted to be secured at any position along the strap member that the wearer desires. This makes the suspenders essentially infinitely adjustable. For this purpose, the strap members are made of a material with a plurality of small loop members 30 on at least one surface. This is shown in FIGS. 3 and 5. Additionally, a piece of Velcro®-type hook material 32 is glued, sewn or otherwise securely affixed to the end portion 16A of the strap member 16. The piece of material 32 has a plurality of small hook members extending therefrom.

Figure 6:
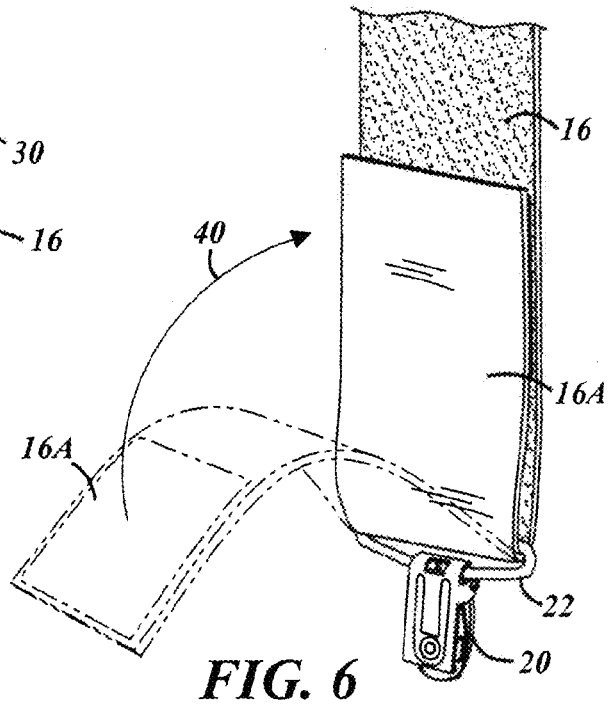
FIG. 6 illustrates the fastening of the end of a front strap member.

When the strap portion 16A is passed through the ring member 22 and pressed up against another portion of the strap member 16, some of the hook members on material 32 mate with some of the loop members 30 and secure the two items together. This movement is shown by arrow 40 in FIG. 6.

Although any type of material with hook members thereon can be used as material 32, preferably the material is one-half of a Velcro®-type fastening system.

Since the loop members 30 are present all along one of the surfaces of the strap members 14 and 16, the suspenders in accordance with the present invention are infinitely adjustable. This allows the suspenders to be easily adjusted to fit any body size or shape. It also allows a wearer to quickly and easily adjust the suspenders at any time for any reason, such as to make them more comfortable on certain days. This also allows the wearer to be able to unfasten the suspenders without undoing the front fasteners.

Although the above description relates specifically to strap member 16, it is to be understood that the same structure and members are to be used for strap member 14 and any other strap members in any other suspender configuration incorporating the present invention.

Preferably, the loop members 30 are provided only on one side of the strap members and this is the side which is worn adjacent the body of the person. (This also is what is shown in the drawings.) The other side of the strap members, that is the outer side, preferably has a smoother and harder surface. This allows outer garments to side easily over the strap members without catching or sticking. Of course, it is also possible that the strap members can have the same hook-type surfaces on both sides, or the suspenders could be worn with the hook side out.

The material used for the strap members 14 and 16 also can be stretchable or elastic. This would provide additional comfort and adjustability to the wearer.

Figure 8:
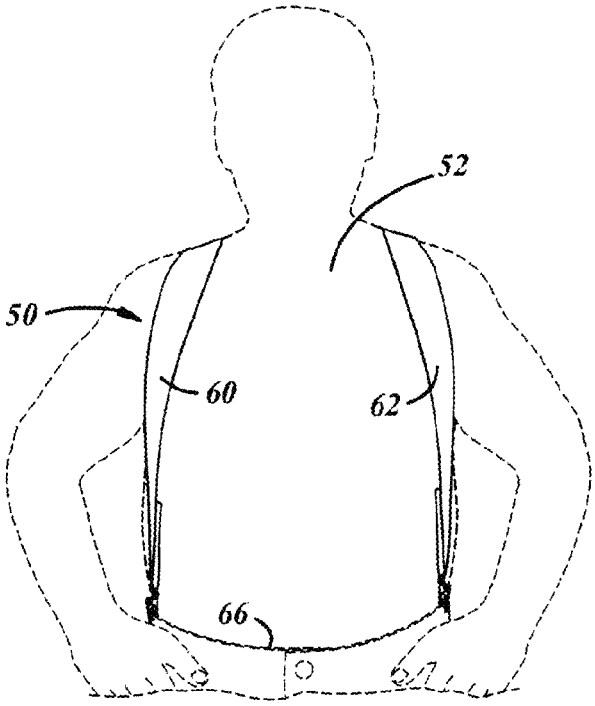
FIGS. 8-11 depict an alternate embodiment of the invention.
Figure 9:
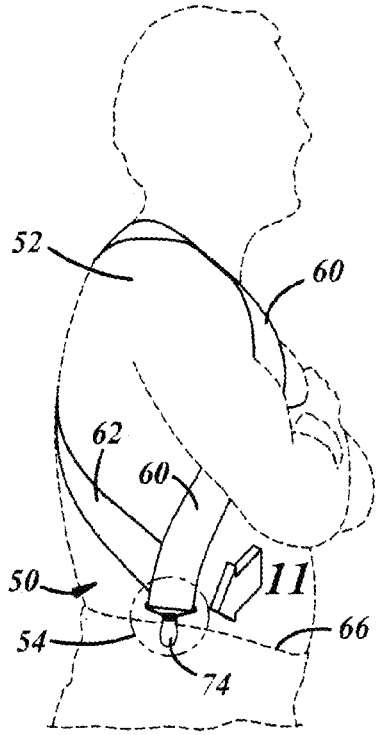
Figure 10:
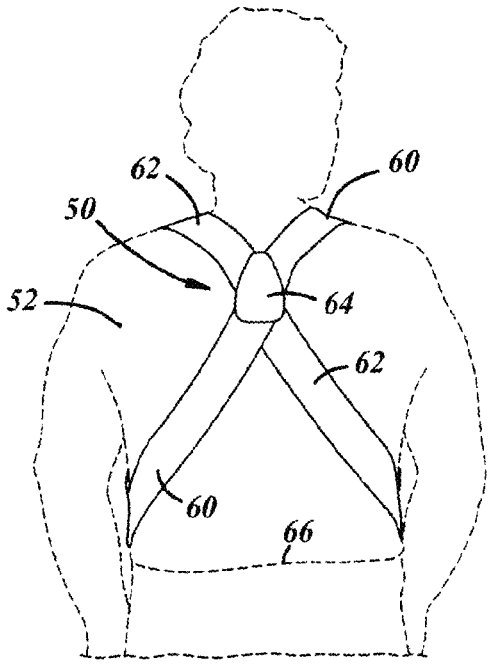
Figure 11:
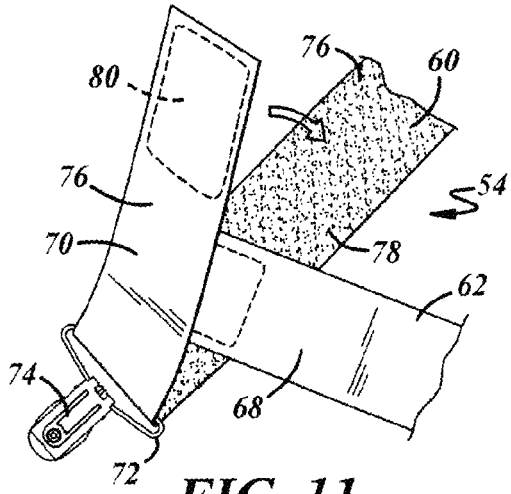

A second embodiment of the present invention is shown in FIGS. 8-11. The strap material, fasteners and adjustment system are preferably the same as those set forth above relative to FIGS. 1-7, although only two fasteners are needed. FIG. 8 depicts the front view of this embodiment 50 as worn by a person 52, while FIG. 9 is a side view and FIG. 10 is a back view. FIG. 11 is an enlarged view of a portion 54 of the figure shown in FIG. 9.

This embodiment is similar to that sold as "Hip-Clip Suspenders" by Hold-Up Suspender Company in Southfield, Mich.

The suspenders 50 have a pair of strap members 60 and 62. The strap members are connected together where they crossover each other 64 on the back or rear of the wearer. The strap members can be connected at 64 in any secure way, such as by sewing.

The strap members 60 and 62 are also attached to each other at a position on the sides of the wearer and adjacent the waistband 66 of the wearer's pants or trousers. This is shown for one side in FIG. 9. The attachment mechanism on the other side of the wearer is the same. The end 68 of strap member 62 is securely attached to strap member 60, while the end portion 70 of strap member 60 is passed through ring member 72 of fastener 74 and releasably attached to itself (at point 76 in FIG. 11). This is the adjustment system or mechanism for the suspenders and is substantially the same as the adjustment mechanism for suspenders 10 as described above.

In this regard, the outer side of surface 76 of the strap member preferably has a hard finish or texture which prevents sticking of any outer garments. The opposite side or surface 78 of the strap member has a plurality of small loop members therein. A piece of Velcro®-type hook material 80 is secured to the end portion 70 of the strap member in order to mate with and be releasably fastened to the loop members.

Embodiments of a shirt-and-sock type suspender are shown in FIGS. 12-19. A preferred embodiment has a "Y"-type shape with two aim-type strap members adapted to be fastened to the wear's shirt and an elongated strap member adapted to be fastened to the wearer's sock. A pair of shirt-and-sock type suspenders are worn by the wearer in order to keep both socks tight and prevent them from falling, and at the same time keeping both sides of the wearer's shirt neat and inside the wearer's pants.

The embodiment shown in FIGS. 12-19 has three strap members secured together at the "V" of the "Y"-shaped suspender. The strap members all preferably are made of an elastic or stretchable-type material with a plurality of loop members on one side. The outer ends of each of the three strap members have fasteners attached thereon for securely holding in place either a skirt or a sock. At least the outer end of the elongated strap member has a hook-type Velco® material attached thereto and is adjustable. The outer ends of the two arm-type strap members are preferably fixedly secured to their fastener members, but they also can have hook-type materials attached to them so they also can be adjustable.

Figure 12:
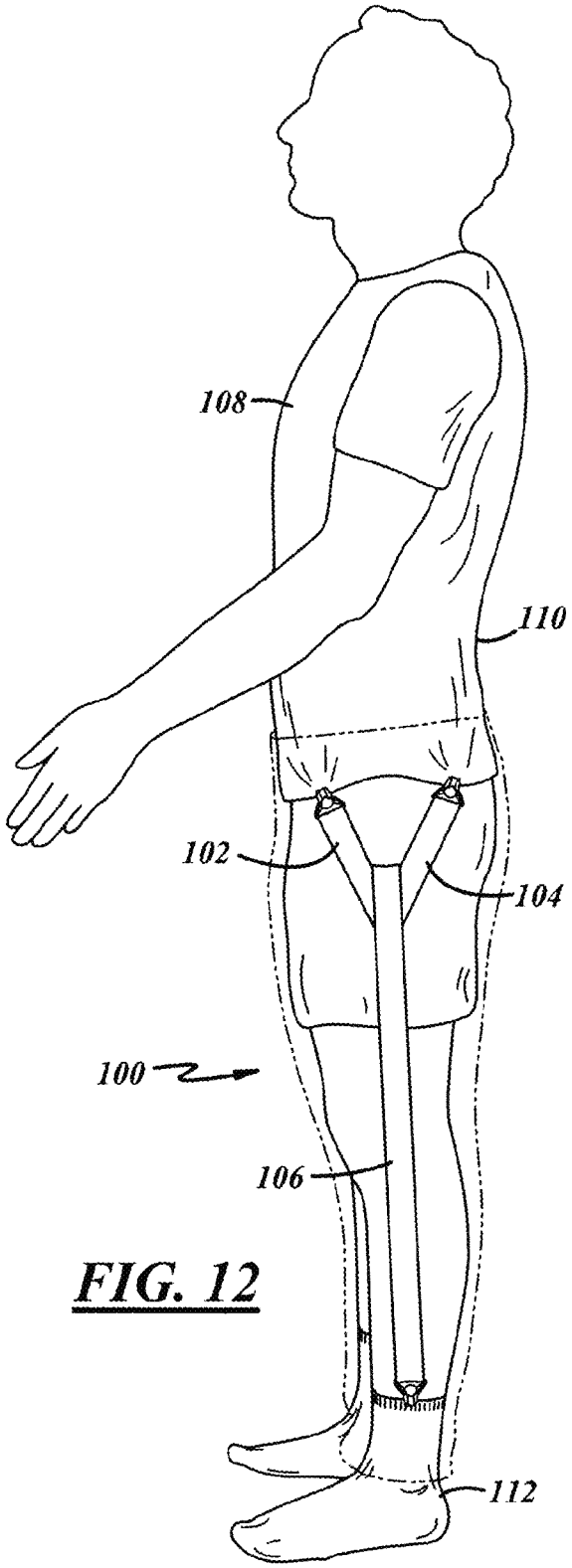
FIG. 12 is a perspective view of an embodiment of a shirt-and-socks type suspenders as worn by a person.
Figure 16:
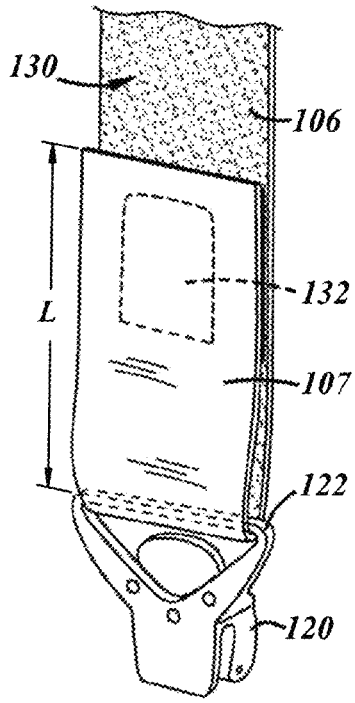
FIG. 16 depicts an infinitely adjustable fastener at the end of a strap member.
Figure 13:
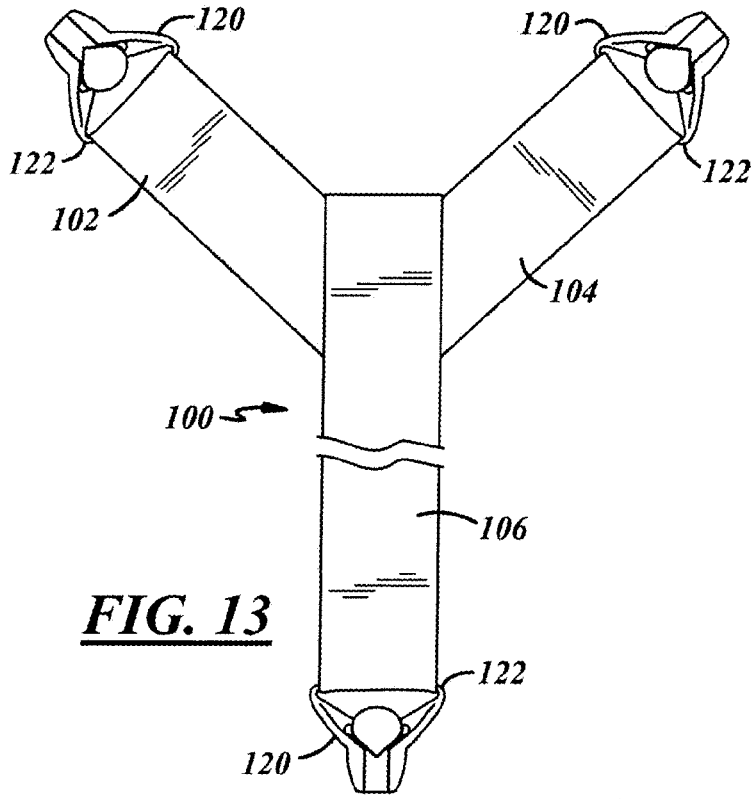
FIG. 13 is a front view of an embodiment of a shirt-and-sock type suspender in accordance with the present invention.
Figure 14:
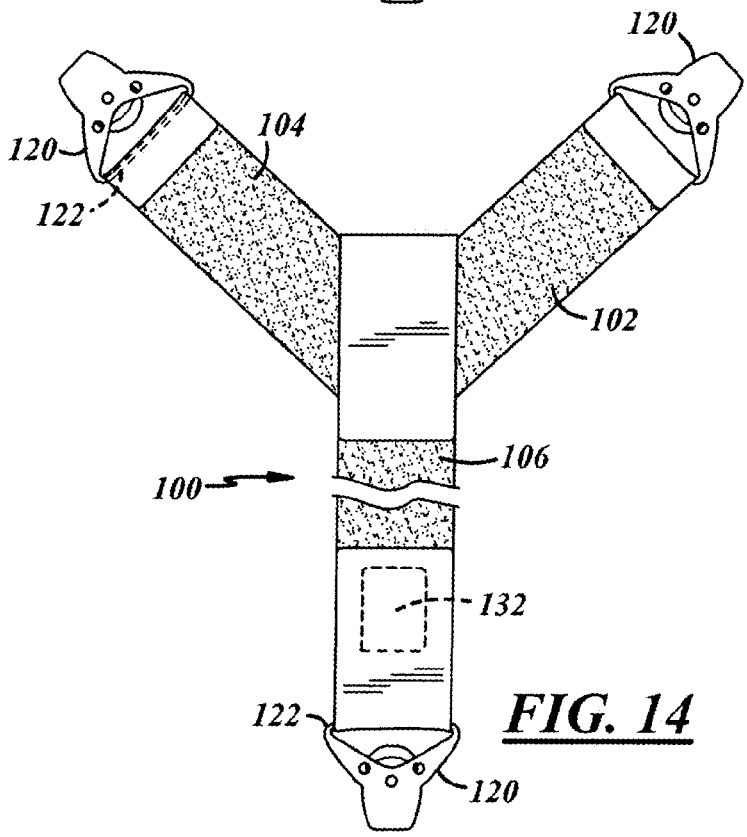
FIG. 14 is a rear view of an embodiment of a shirt-and-sock type suspender in accordance with the present invention.
Figure 15:
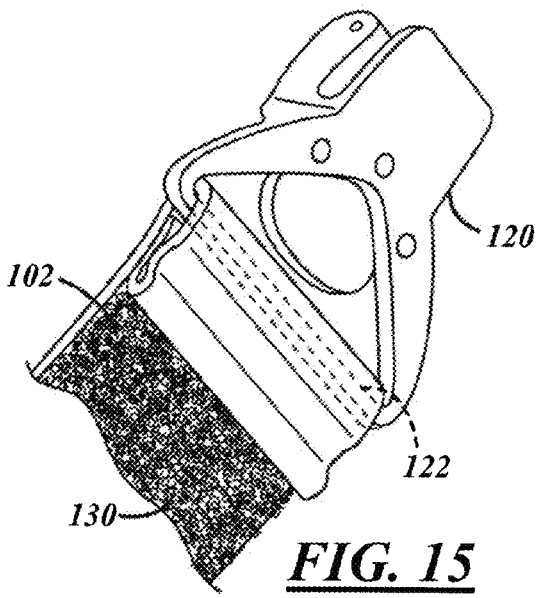
FIG. 15 depicts a fastener fixedly attached to the end of a strap member of the embodiment shown in FIGS. 13-14.

As shown in the embodiment illustrated in FIG. 12-14, the suspender 100 has a pair of arm-type strap members 102 and 104 attached to an elongated strap member 106. The three strap members are secured together in a "Y"-shaped configuration and are adapted to be worn by a wearer 108 in the manner shown in FIG. 12. The length of the suspender 100 is sufficient to extend from about the waist of the wear to the lower calf or ankle of the wearer in order to be attached at the upper end to the wearer's shirt 110 and at the other end to the wearer's sock 112. With a pair of suspenders 100, the wearer can maintain his shirt looking neat and always tucked in his/her pants, and at the same time, keep his/her socks tight and prevent them from falling.

In this regard, it should be understood that the invention is not to be limited to suspenders having the precise structure and configuration as shown in FIGS. 12-14. The invention can be utilized with other sizes, shapes and strap configurations of suspenders which fulfill the same objective and purpose.

Fastener members 120 are used to connect the strap members to the shirt or socks worn by the wearer. Preferably, the fasteners 120 are plastic clip-type fastener members, having the structure and fastening mechanism shown in the drawings. The fasteners can be any other conventional type of suspender fasteners, however, such as those shown in U.S. Design Pat. Nos. D614,946 and D619,495. The invention can also be used with other types of conventional fastener members used with suspenders today, including buttons and snaps.

Preferably, the three fastener members 120 on each suspender 100 are the same, but each could also be different from one another. As shown, each fastener has a loop or ring member 122 attached to them. The ring member 122 allows the strap members to slide through them.

The end portion 107 of the elongated strap member 106 is adapted to be secured at any position along the strap member that the wearer desires. This makes the suspender 100 essentially infinitely adjustable to fit and extend between the wearer's shirt and socks. For this purpose, the strap member 106 preferably is made of a material with a plurality of small loop members 130 on at least one surface. This is shown in FIGS. 14-17. Additionally, a piece of Velcro®-type hook material 132 is glued, sewn or otherwise securely affixed to the end portion 107 of the strap member 106. The piece of material 132 has a plurality of small hook members extending therefrom. (This is the same as the embodiment described above with reference to FIGS. 3-4.)

When the strap portion 107 is passed through the ring member 122 and pressed up against another portion of the strap member 106, some of the hook members on material 132 mate with some of the loop members 130 and secure the two items together. This movement is shown by arrow 40 in FIG. 6. This is the same as the pant-type suspenders described above with reference to FIGS. 2-6.

Although any type of material with hook members thereon can be used as material 132, preferably the material is one-half of a Velcro®-type fastening system.

Since the loop members 130 are present all along one of the surfaces of the strap 106, the suspender is infinitely adjustable. This allows the suspenders to be easily adjusted to fit any body size or shape. It also allows a wearer to quickly and easily adjust the suspenders at any time for any reason, such as to make them more comfortable on certain days.

Although the above description relates specifically to strap member 106, it is to be understood that the same structure and members can be used for strap members 102 and 104 and any other strap members in any other suspender configuration incorporating the present invention. In accordance with a preferred embodiment of the invention, however, the end portions of the strap members 102 and 104 are fixedly secured to the ring member of the fasteners 120, in the manner shown in FIG. 15 and described above with respect to FIG. 7.

The loop members 130 are provided only on one side of the strap members and this can be the side which is worn adjacent the body of the person or worn facing outwardly. The other side of the strap members preferably has a smoother and harder surface. If the smoother and harder side is worn outwardly, this will allow outer garments to slide more easily over the strap members without catching or sticking. Of course, it is also possible that the strap members can have the same hook-type surfaces on both sides, or the suspenders could be worn with the hook side out.

The material used for the strap members 102, 104 and 106 also preferably is stretchable or elastic. This would provide additional comfort and adjustability to the wearer.

Figure 17:
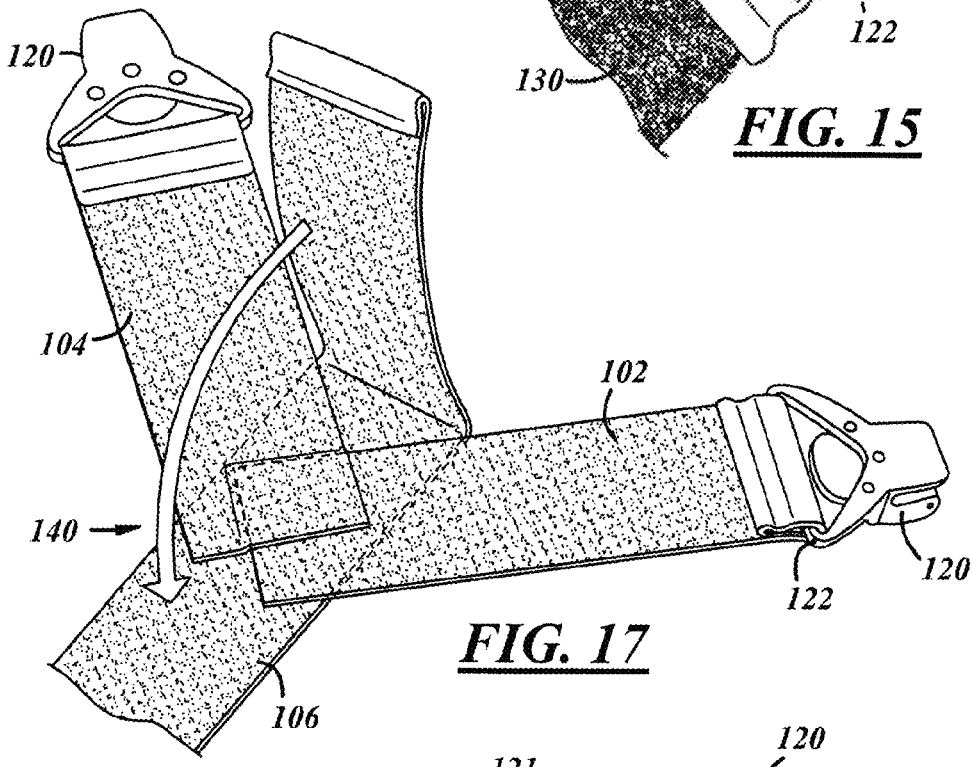
FIG. 17 illustrates the attachment of an elongated strap member to two arm members.

The three strap members 102, 104 and 106 are attached together at the "V" 140 of the suspenders where they overlap. This is shown in FIG. 17. The straps can be secured together at 140 by any mechanism or method which securely affixes them together, such as by being glued or being sewn together.

Figure 18:
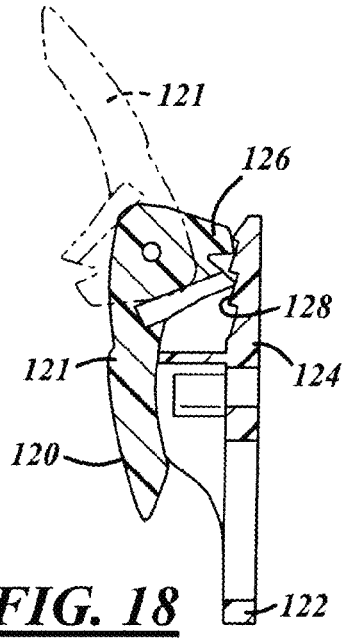
FIG. 18 depicts a fastener for use with an embodiment of a skirt-and-socks type suspender illustrating its open and closed positions.
Figure 19:
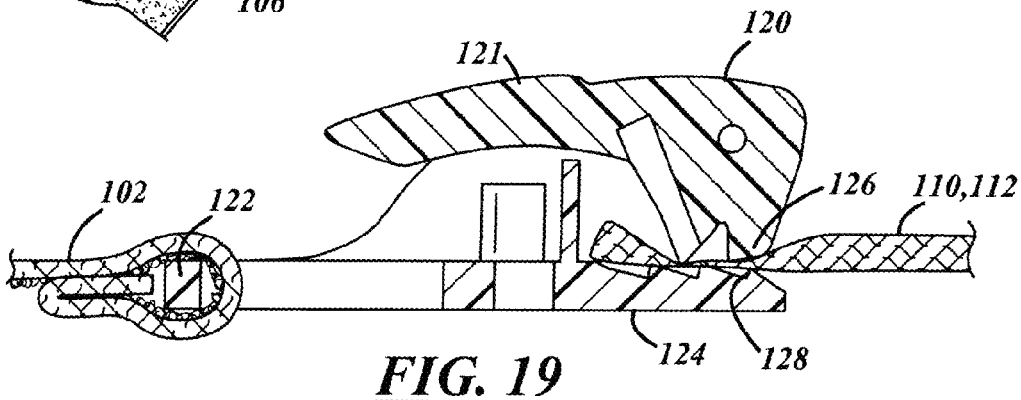
FIG. 19 depicts a fastener for use with an embodiment of a skirt-and-socks type suspender in a closed position holding a shirt garment or a sock.

FIGS. 18 and 19 illustrate the operation of preferred fasteners 120 used with the present invention. FIG. 18 shows the fastener 120 in the open and closed positions. The locking member 121 is pivotably attached to the base member 124 and has a series of ridges 126 which, when closed, interlock with mating ridges 128 on the base member. FIG. 19 shows the fastener 120 in the closed or locked position securely holding onto a piece of material 110, 112 which could be the shirt tail of a wearer's shirt or the upper part of a wearer's sock.

The present invention eliminates the metallic or plastic buckles that are in use today in most suspenders for adjustment of the straps on the wearers. This eliminates the possibility of unsightly bumps or bulges under the outer garment, whether it be a shirt or a pair of form-fitting pants. The unique shirt-and-sock type invention keeps the wearer's shirt neat and tucked in and at the same time keeps the wearer's socks from falling.

Although the invention has been described with respect to preferred embodiments, it is to be also understood that it is not to be so limited since changes and modifications can be made therein which are within the full scope of this invention as detailed by the following claims.

What is claimed is:

1. Suspenders for wearing over the shoulder of a person for attachment to the waistband of the person's pants, the suspender comprising:

a first strap member and second strap member, each strap member having a first end and a second end and a first surface and a second surface;

said first and second strap members being connected together at a substantially mid-point position between said first and second ends, such position corresponding to about the mid-point of the back of a wearer wearing the suspenders;

said first surface of each of said first and second members having a plurality of loop members extending substantially over said first surface, said loop members being loops of a hook and loop type fastener material, and said second surface of each of said first and second strap members being smooth substantially over said second surface;

fastener members positioned adjacent said first ends of each of said first and second strap members;

said first ends of each of said first and second strap members being adjustable to adjust the length of said first and second strap members;

a single hook-type member secured on said first surfaces of each of said first and second strap members adjacent said fastener members;

said hook-type member having a plurality of hook members thereon, said hook members being hooks of a hook and loop type fastener material;

said second end of said first strap member being connected adjacent said first end of said second strap member; and said second end of said second strap member being connected adjacent said first end of said first strap member;

wherein said hook-type members on each of said first and second strap members are selectively secured to said loop members at any position along said first surfaces;

wherein buckles on said first and second strap members for adjustment are not present.

2. The suspenders as described in claim 1 wherein said fastener members are clip-type fastener members.

3. The suspenders as described in claim 1 wherein said first and second strap members are connected together at said position corresponding to the back of a wearer by sewing.

4. Suspenders for wearing over the shoulder of a person for attachment to the waistband of the person's pants, the suspender comprising:

a first strap member and second strap member, each strap member having a first end and a second end and a first surface and a second surface;

said first surface of each of said first and second members having a plurality of loop members extending substantially over said first surface, said loop members being loops of a hook and loop type fastener material;

said second surface of each of said first and second strap members being smooth substantially over said second surface;

a first fastener member positioned adjacent said first end of said first strap members and a second fastener member positioned adjacent said first end of said second strap member;

said first ends of each of said first and second strap members being adjustable to adjust the length of said first and second strap members;

at least one hook-type member secured on said first surfaces of each of said first and second strap members adjacent said fastener members;

said hook-type member having a plurality of hook members thereon, said hook members being hooks of a hook and loop type fastener material;

said second end of said first strap member being connected adjacent said first end of said second strap member; and said second end of said second strap member being connected adjacent said first end of said first strap member;

wherein said hook-type members on each of said first and second strap members are selectively secured to said loop members at any position along said first surfaces;

wherein said first fastener member is adapted to attach both the first end of said first strap member and said second end of said second strap member to a waistband of a person's pant; and wherein said second fastener member is adapted to attach both the first end of said second strap member and the second end of said first strap member to a waistband of a person's pants.

5. The suspenders as described in claim 4 wherein said fastener members are clip-type fastener members.

* * * * *